US005313860A

United States Patent [19]

Liou

[11] Patent Number: 5,313,860

[45] Date of Patent: May 24, 1994

[54] COMPOUND TOOL

[76] Inventor: Mou T. Liou, No. 25, Lane 86, Tawei Rd., Tali Hsiang, Taichung Hsien, Taiwan

[21] Appl. No.: 970,796

[22] Filed: Nov. 3, 1992

[51] Int. Cl.[5] ..... B25P 1/00

[52] U.S. Cl. ..... 81/437; 81/177.6; 81/124.3; 7/138; 7/165

[58] Field of Search ..... 81/124.3, 124.4, 125.1, 81/177.4, 177.6, 186, 437, 439, 440; 7/138, 165

[56] References Cited

U.S. PATENT DOCUMENTS 851,428 4/1907 Morrill ..... 81/124.3
1,072,479 9/1913 Martindale ..... 81/124.3
1,369,829 3/1921 Minges ..... 81/437 X
2,471,593 5/1949 Toye ..... 81/177.6
3,931,749 1/1976 Evans ..... 81/186 X

*Primary Examiner*—James G. Smith
*Attorney, Agent, or Firm*—Fitch, Even, Tabin & Flannery

[57] ABSTRACT

A tool includes a head portion formed on an elongated body, and one or more screw driver shanks pivotally engaged on the body. The head portion includes two engaging surfaces communicated with each other and having different sizes in order to drive objects of different sizes.

6 Claims, 4 Drawing Sheets

COMPOUND TOOL

BACKGROUND OF THE INVENTION

1. Field of the Invention

The present invention relates to a compound tool, and more particularly to a multi-purpose wrench and screw driver combination.

2. Description of the Prior Art

Wrenches are generally provided for actuating and driving followers, such as bolts, nuts, sockets etc. However, each of the wrenches fits only one size of the followers, such that a plurality of wrenches are required when driving followers with various sizes; in addition, it is required to frequently change the wrenches when driving various followers. This is very inconvenient.

The present invention has arisen to mitigate and/or obviate the afore-described disadvantages of the conventional wrenches.

SUMMARY OF THE INVENTION

The primary objective of the present invention is to provide a compound tool which includes a multi-purpose wrench having a plurality of engaging surfaces in order to drive a plurality of followers of different sizes.

The other objective of the present invention is to provide a compound tool which includes a plurality of screw drivers for driving various kinds of screws.

In accordance with one aspect of the invention, there is provided a tool comprising a body including a head portion formed thereon, at least one screw driver shank pivotally engaged on the body, the head portion including at least two first engaging surfaces formed therein and communicated with each other and having different sizes in order to drive at least two different sizes of objects, Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
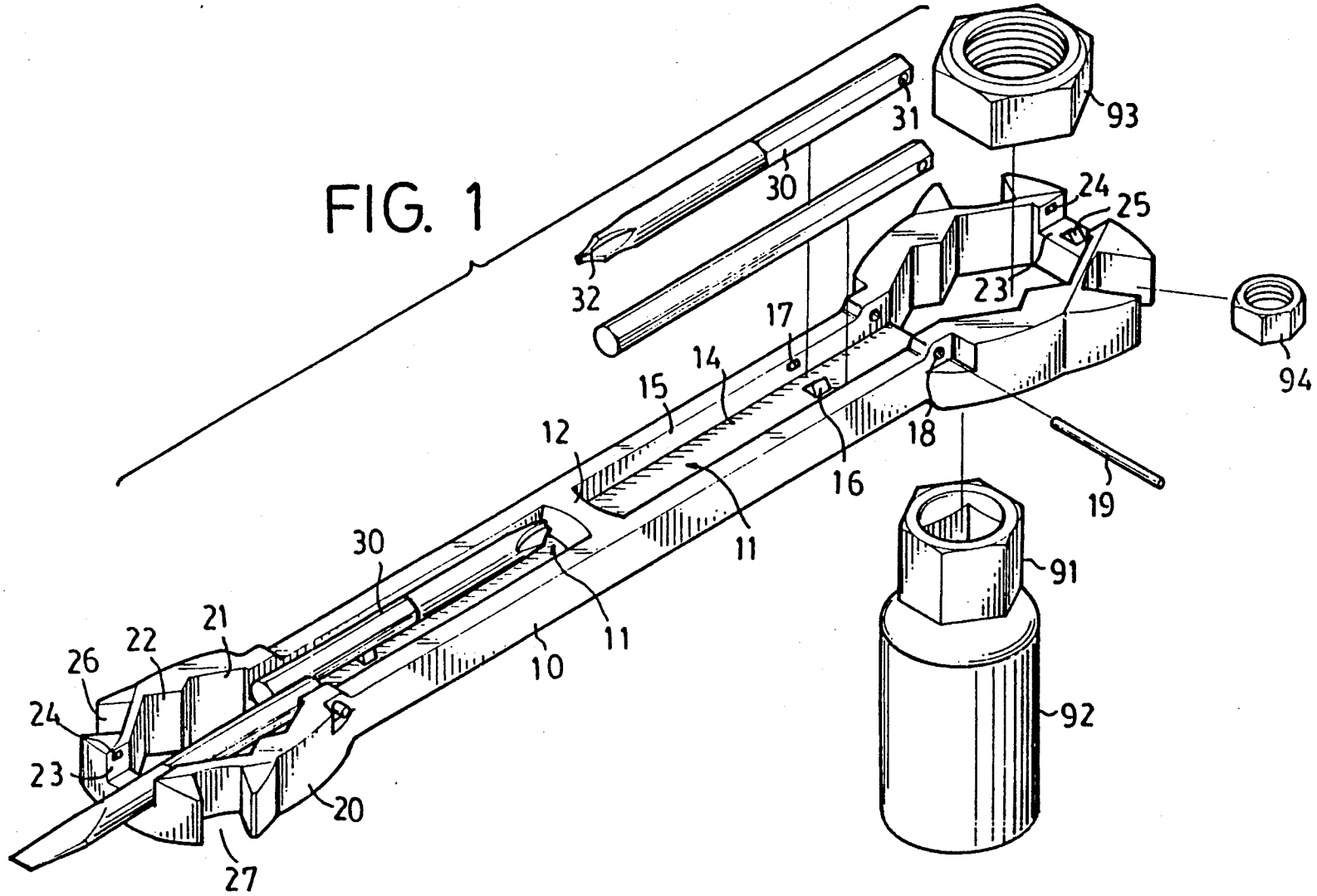
FIG. 1 is a partial exploded view of a tool in accordance with the present invention.
Figure 2:
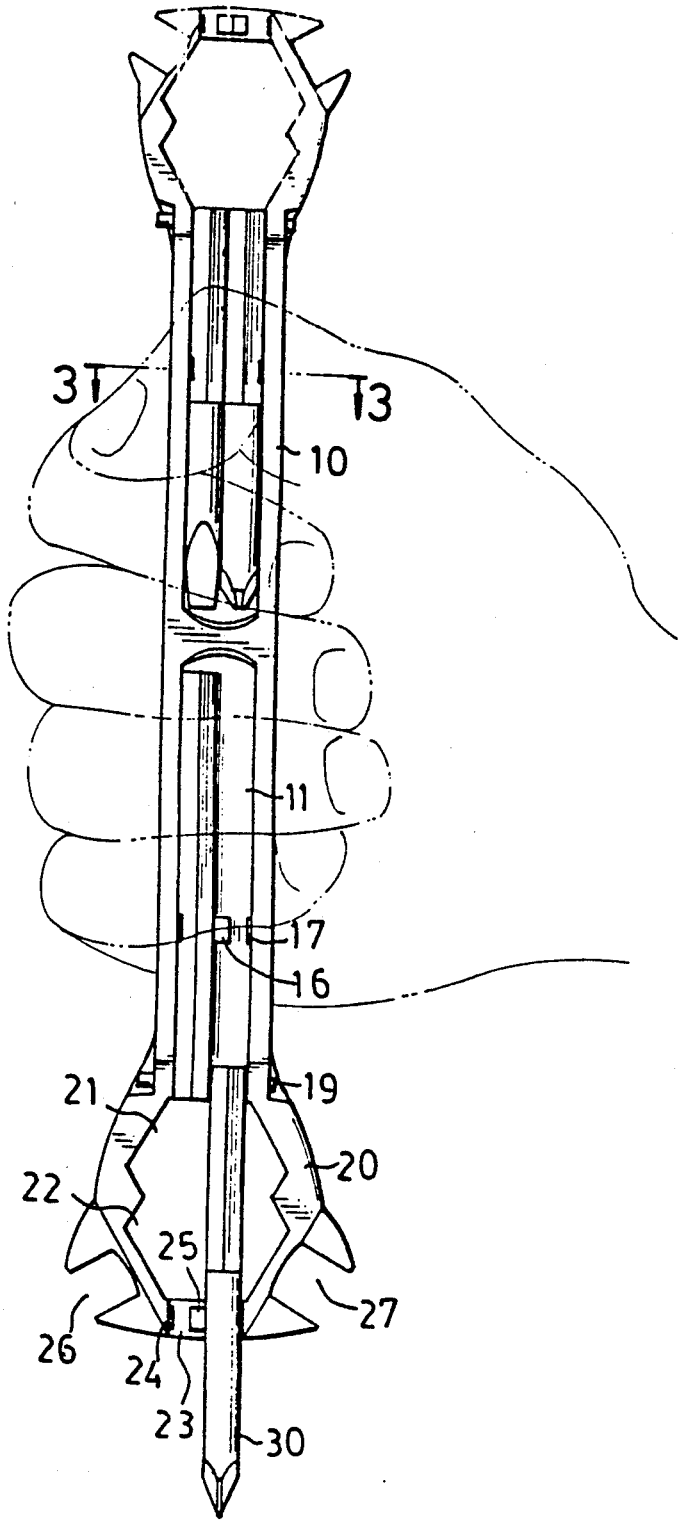
FIG. 2 is a top plane view of the tool.
Figure 3:
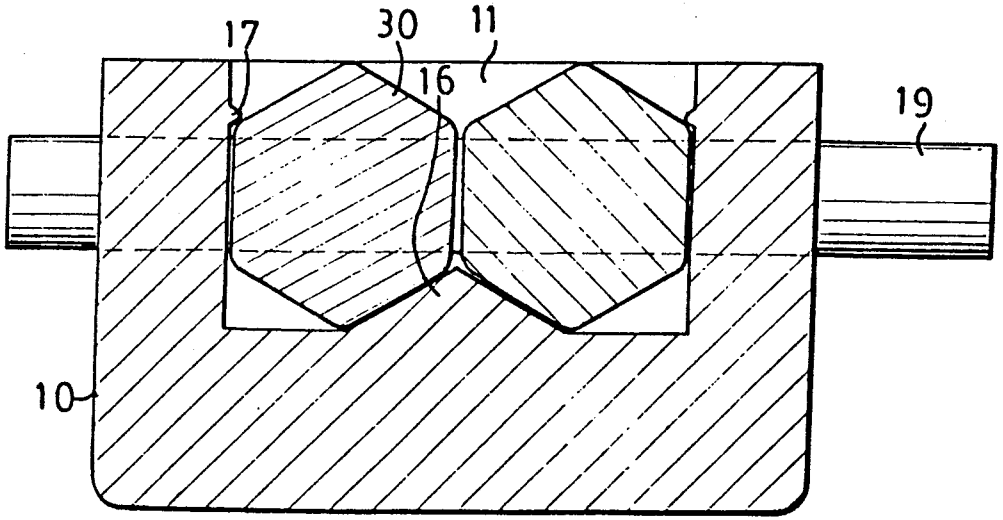
FIG. 3 is a cross sectional view taken along lines 3—3 of FIG. 2.

Referring to the drawings, and initially to FIGS. 1 and 2, a compound tool in accordance with the present invention comprises generally a wrench including a plurality of engaging surfaces for tightening or loosening a plurality of objects or followers, such as bolts, nuts, sockets or other parts of machinery, of different sizes, and including a plurality of screw drivers for driving various kinds of screws.

The compound tool comprises an elongated body 10 including two ends each having a head portion 20 formed integral thereon, the body 10 includes an upper surface having a groove longitudinally formed therein and substantially extended along the length thereof, a partition 12 formed in the middle portion of the groove so as to separate the groove into two opposite compartments 11, each defining a bottom surface 14 and a pair of side surfaces 15. A projection 16 is formed in the middle portion of the bottom surface 14 of each of the compartments 11 of the groove 11, and a protrusion 17 is formed in each of the side surfaces 15 of the compartments 11, two holes 18 are formed in each of the end portions of the body 10 and located in the abutment area of the body 10 and the head portions 20 in order to accommodate a pin element 19.

Two screw driver shanks 30 each includes a hole 31 formed in one end thereof for engagement with the pin element 19 such that the shanks 30 are rotatable about the pin element 19 and includes a head 32 formed on the other and thereof, the shanks 30 are received in the compartments 11 and retained in place by the projection 16 and the protrusion 17. As will be evident heads 32 include a variety of standard flat, Philips, and Robertson heads. Each of the screw driver shanks 30 is hexagonal in cross-section, however, alternatively, various geometrical cross-section configurations may be selected for shanks 10.

Each of the head portions 20 includes two engaging surfaces 21, 22 formed therein each having a hexagonal cross section, and communicated with each other and partially intersected with each other, as best shown in FIG. 2, it is preferable that the engaging surfaces 21, 22 have a quarter intersected with each other, similar to a Siamese twins, the two engaging surfaces 21, 22 have different sizes such that the two head portions 20 are capable of driving four followers of different sizes, for example, as shown in FIG. 1, the engaging surfaces 21, 22 are capable of driving the nut portion 91 of a socket 92 and a nut 93. Each of the head portions 20 further includes a third engaging surface 26 and a fourth engaging surface 27 formed in the outer peripheral portion thereof, the engaging surfaces 26, 27 also have different sizes and preferably have smaller sizes than that of the other engaging surfaces 21, 22 such that the engaging surfaces 26, 27 are capable of driving smaller nuts 94 (FIG. 1). A notch 23 is formed in each of the head portions 20 and aligned with the compartment 11 and communicated with the engaging surfaces 21, 22 in order to receive the shanks 30 when the shanks 30 are rotated to a working position as shown in FIGS. 1 and 2. A projection 25 and a pair of protrusions 24 are formed in each of the notches 23 for retaining the shanks 30 in place, similar to the projection 16 and the protrusions 17.

Figure 4:
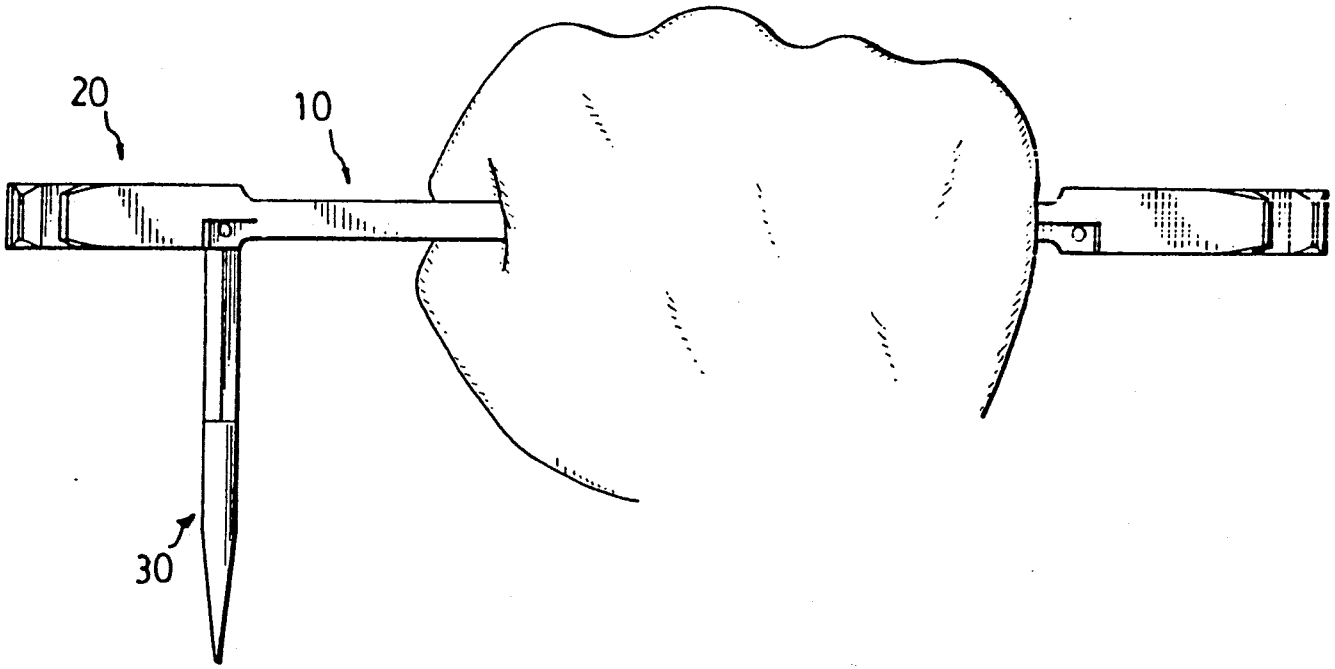
FIG. 4 is a side elevational view illustrating the operation of the tool.

In operation, the engaging surfaces 21, 22, 26, 27 of the two head portions 20 are capable of driving eight different sizes of the followers. In addition, the compound tool includes four screw drivers 30 such that the compound tool is capable of driving four different types of screws. The screw driver shanks 30 may be engaged in the notches 23, as shown in FIGS. 1 and 2, or arranged in perpendicular to the body 10, as shown in FIG. 4 so as to work as a screw driver.

Accordingly, the compound tool in accordance with the present invention includes a plurality of engaging surfaces for driving screws and nuts of different sizes and includes a plurality of screw driver shanks for driving various kinds of screws.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

an elongated body having two ends;

a head portion having a first end integral with at least one of said ends of said elongated body and having a second end which is a free end with a notch formed therein with first retaining means formed in said notch, said head portion defining a first plurality of engaging surfaces for driving objects;

said elongated body having a groove extending along a portion of the length of the body, said groove defining a storing compartment;

a second retaining means formed in said storing compartment;

two holes formed in said body adjacent said first end of said head portion and disposed on either side of the groove;

a pin element having opposite ends accommodated in a respective one of said two holes; and a screwdriver shank mounted to the pin element for pivoted rotation thereabout between a working position in which the screwdriver shank is received within said notch and retained within said notch by said first retaining means, and a storage position in which the screwdriver shank is received within said storing compartment and retained in said storing compartment by said second retaining means.

2. A tool in accordance with claim 1 wherein said head portion defines a second plurality of engaging surfaces for driving objects of different size than objects engageable by said first plurality of engaging surfaces.

3. A tool in accordance with claim 1 wherein said storing compartment comprises a bottom surface and a pair of side surfaces, and said second retaining means comprises a projection formed on a middle portion of said bottom surface and a protrusion formed on each of said side surfaces.

4. A tool in accordance with claim 3 wherein said notch comprises a bottom surface and a pair of side surfaces, and said first retaining means comprises a projection formed on a middle portion of said bottom of said notch and a protrusion formed on each of said side surfaces of said notch.

5. A tool, comprising:

an elongated body having two ends;

respective head portions each having a respective periphery defining an engaging surface for driving objects, the respective head portions having a first end integral with a respective one of said body ends and having a second end with a notch formed therein;

the notch having a bottom surface and a pair of side surfaces and having a first projection formed in a middle portion of said bottom surface of said notch, and having a first protrusion formed on each of said side surfaces of said notch;

said body having a surface with a groove extending along a length of the body with a partition in a middle portion of said groove separating said groove into two opposite storing compartments, with each of said storing compartments having a bottom surface and a pair of side surfaces, a second projection being formed in a middle portion of said bottom surface of each storing compartment, and a second protrusion being formed on each of said side surfaces of each of said storing compartments for retaining a screwdriver between said projection and said protrusion;

a screwdriver shank pivotably attached to the base adjacent one of said head portions to allow pivotal movement of said screwdriver shank between a working position in which the screwdriver shank is received within said notch and retained within said notch by said first projection and said first protrusion, and a storage position in which the screwdriver shank is received within said storing compartment and retained in said storing compartment by said second projection and said second protrusion.

6. A tool in accordance with claim 5 wherein at least one of said head portions defines a second plurality of engaging surfaces for driving objects of different size than objects engageably by said first plurality of engaging surfaces.

* * * * *

UNITED STATES PATENT AND TRADEMARK OFFICE

CERTIFICATE OF CORRECTION

PATENT NO. : 5,313,860

DATED : May 24, 1994

INVENTOR(S) : Mou T. LIOU

It is certified that error appears in the above-indentified patent and that said Letters Patent is hereby corrected as shown below:

Claim 6, Column 4, Line 42, Change "engageably" to --engageable--.

Signed and Sealed this

Eighteenth Day of October, 1994

*Attest:*

*Attesting Officer*

BRUCE LEHMAN

*Commissioner of Patents and Trademarks*